United States Patent [19]

Goldfarb et al.

[11] Patent Number: 4,938,481

[45] Date of Patent: Jul. 3, 1990

[54] INCREMENTALLY ADVANCING TOY APPARATUS

[75] Inventors: Adolph E. Goldfarb, 1432 S. Eastwind Cir., Westlake Village, Calif. 91361; Martin I. Goldfarb, Los Angeles, Calif.

[73] Assignee: Adolph E. Goldfarb, Westlake, Calif.

[21] Appl. No.: 310,041

[22] Filed: Feb. 10, 1989

[51] Int. Cl.[5] ..... A63F 3/00

[52] U.S. Cl. ..... 273/243; 273/290; 446/290; 446/465

[58] Field of Search ..... 273/85 D, 85 E, 238, 273/243, 263, 281, 288, 289, 140, 108; 446/289, 290, 465

[56] References Cited

U.S. PATENT DOCUMENTS

| | | | |
|---|---|---|---|
| 1,212,332 | 1/1917 | Ensign et al. | 446/289 |
| 3,835,583 | 9/1974 | Manning | 446/465 |
| 3,984,105 | 10/1976 | Breslow | 273/243 X |
| 4,157,183 | 6/1979 | Meyer et al. | 273/243 |
| 4,225,138 | 9/1980 | Wolf | 273/243 |
| 4,277,909 | 7/1981 | Rainwater | 446/289 |
| 4,318,242 | 3/1982 | Pin-Houng | 446/290 X |
| 4,575,354 | 3/1986 | Wakayama et al. | 446/465 X |

FOREIGN PATENT DOCUMENTS

| | | | |
|---|---|---|---|
| 142526 | 10/1953 | Sweden | 446/290 |

*Primary Examiner*—William E. Stoll

*Attorney, Agent, or Firm*—Ashen Golant Martin & Seldon

[57] ABSTRACT

The illustrated action toy apparatus comprises an incrementally advancing catcher unit that may be in the form of an animated character such as a shark. The unit moves along a succession of areas of a path. Objects which may represent fish or the like are disposed on the areas. A fish on one area is caught or "eaten" by the shark when the shark reaches that area. As the shark advances to an area, its forward end rises to an elevated position to permit that end to pass over and then come back down upon a fish on that area. The forward and up and down movement of the illustrated shark unit is provided by a motor-driven cam. To maximize continuous playtime, the shark unit is tethered to the center of a gameboard so that it travels around a circular path on the board.

27 Claims, 4 Drawing Sheets

INCREMENTALLY ADVANCING TOY APPARATUS

BACKGROUND OF INVENTION

In the prior art there have been various toy devices representing animated characters or creatures where the mouth opened and then closed about a victim or object to be eaten.

One prior art shark game involved a stationary shark where the jaw remained open for a predetermined time interval and then closed to define the end of the game period.

There was an item made by Action Toy and Games of Great Britain which appeared in their 1988 toy catalog called "Shark Alert" where a randomly programmed toy shark wiggled about and operated to eat various objects.

There was also a toy item known as "Hungry Hippos" where a plurality of manually operated hippo characters tilted their heads upwardly while the whole unit representing the animal moved forwardly. The head then came down upon marbles or the like to "gobble up" these marbles. The hippos were stationary except for the limited forward and backward movement and the pivotal lifting of the head.

There have been various other devices where the pivoted mouth of the creature opened and shut.

Further, U.S. Pat. No. 4,162,069 shows a toy vehicle which advances along a roadway while the players hurry to add planks to extend the roadway before the vehicle arrives at an unfinished portion and goes off the end.

SUMMARY OF THE DISCLOSURE

The illustrated play action apparatus comprises an incrementally advancing catching or eating unit that may be in the form of an animated character such as a shark with a mouth at its forward end. The illustrated unit incrementally moves forward while also having its forward end lift up and then fall downwardly onto a supporting surface. This action enables that forward end to move over and then come down upon and capture an object (such as a play piece in the form of a small fish) disposed on the surface. The forward end of the shark is hollow and provides a receptacle for receiving the object therein. This action creates the illusion that the depicted mouth of the shark is opening and then closing upon the fish although it will be noted that the entire housing simply rises upwardly at its forward end and then comes back downwardly onto the supporting surface. The fish may be disposed along a path and the shark unit may incrementally advance along the path so as to chase or follow the fish. The apparatus may be utilized in the form of a game where the play of the game involves the players trying to advance their fish pieces at a sufficiently rapid rate to keep ahead of and out of the mouth of the advancing shark.

The illustrated shark unit includes a frame which carries batteries on one side and an electric motor on the other side for symmetry of weight and balance. The frame may also include a body portion depicting the shark having a mouth with multiple teeth at the forward end. The illustrated motor drives a rotary cam which is positioned and proportioned to sequentially engage the supporting surface to advance while also raising up the forward end of the shark body and then allowing that forward end to move back downwardly onto the advanced location of the shark. The illustrated cam, as will be discussed more fully below, may also provide a pause between each incremental movement of the shark.

The illustrated shark unit is connected by a pivoted arm to a center post on a game board. The illustrated game board provides a circular pathway which has a series of generally equally spaced areas. The board and shark unit are proportioned and arranged so that each incremental movement of the shark unit advances it along the circular pathway from one pathway area to the next pathway area.

IN THE DRAWINGS

DETAILED DESCRIPTION OF THE DRAWINGS

Figure 1:
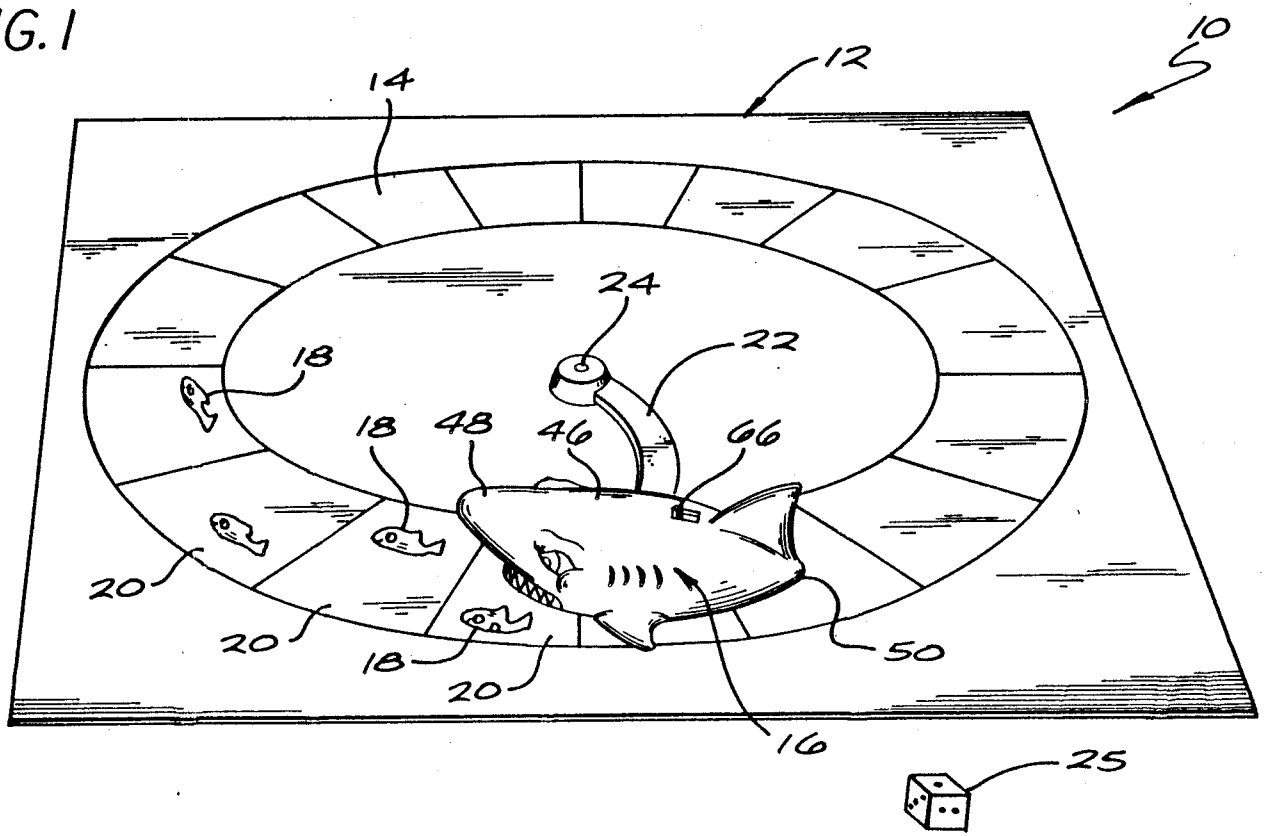
FIG. 1 is a perspective view of a presently preferred embodiment of the invention in the form of a game board, a pivotally-mounted incrementally-advancing shark unit and a plurality of fish victims disposed on a circular path on the board in front of the shark.

Very generally, the illustrated apparatus 10 comprises a game board 12 with a circular pathway 14. An incrementally advancing unit 16 that represents a shark is pivotally connected to the board so as to advance along the circular pathway. A plurality of play pieces 18 in the form of small fish are disposed on the pathway. If the shark unit 16 catches a fish 18 in its advance, the fish is "eaten".

FIG. 1 disloses the flat rectangular game board 10 which defines the circular path 14 on its upper surface. The path has a series of generally equal areas 20 therealong The advancing shark unit 16 is mounted to the board for movement along the circular path. The path and the shark unit are configured and arranged so that the shark unit incrementally moves from one area to the next along the pathway. The shark unit is shown mounted on a rigid arm 22 which is pivotally mounted to a post 24 at the center of the board, which is also the center of the circular pathway. A plurality of objects or play pieces such as the small plastic fish 18 are disposed on the areas 20 of the pathway forwardly of the advancing shark unit. The fish 18 may be different colors, with each player being provided with one or more fish of a particular color. If the shark unit gets to an area where there is a fish, the shark unit will "gobble up" or "eat" the fish on that area. The object of the game is for the players to try to keep their fish ahead of the advancing shark unit. The rules of the game may take various desired forms. For example, the players may take turns rolling dice 25 to see how many spaces forward they may move their fish. The last player to have a surviving fish may be declared the winner.

Figure 2:
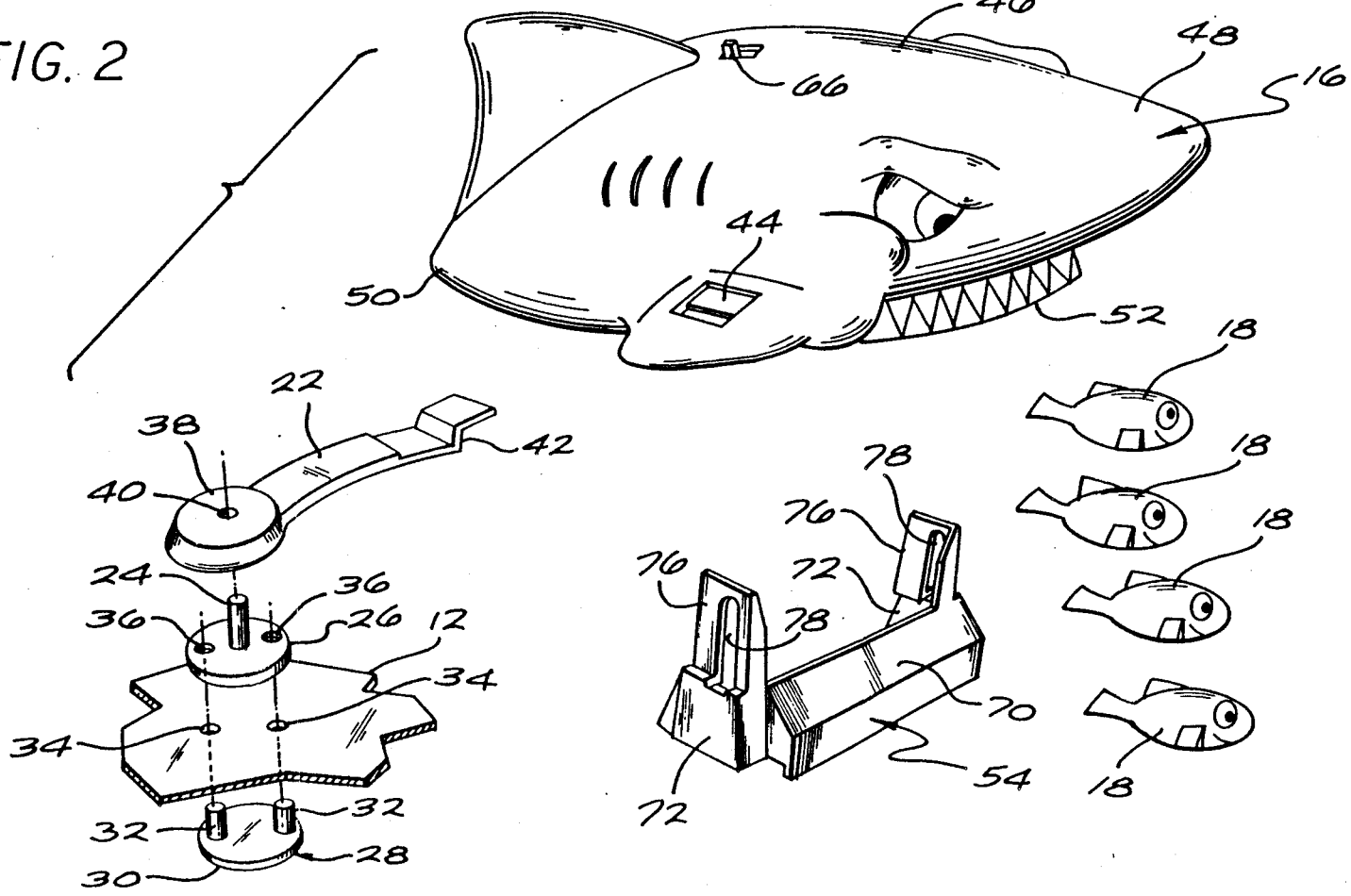
FIG. 2 is an exploded perspective view of various components making up the apparatus of FIG. 1.

FIG. 2 illustrates some of the preferred construction of the illustrated toy apparatus 10. The center post 24 extends upwardly from a small circular top disk 26 which fits atop the center portion of the game board 12 and is held in position against rotation by being interconnected with a bottom disk portion 28. The bottom disk portion 28 may include a bottom disk 30 and a pair of upwardly extending pins 32 which pass through mating holes 34 in the game board and mating holes 36 in the top disk. The illustrated rigid tether arm 22 may have a center portion 38 with a hole 40 through which the post 24 extends so that the arm may pivotally revolve around the post. The arm 22 may have a jogged or offset outer end 42 which may releasably interconnect with a mating slot 44 on an inwardly extending fin portion of the shark unit. This arrangement provides for the shark unit moving incrementally along the circular pathway 14 from area to area under its own power as it pivots around the center post 24. The illustrated construction further facilitates the easy assembly and disassembly of the parts for storage and shipment of the play apparatus.

As seen best in FIGS. 1 and 2, the shark unit 16 includes an outer body or casing 46 that is molded or formed to represent the forward portion of a shark. In particular, it will be noted that this representation of the forward portion of the shark creates the illusion that the remainder of the shark is extending into the water as represented by the surface of the game board. In this connection, as will be disclosed more fully below, the action of the shark unit is to pivot its forward end 48 upwardly while its rear end 50 remains in contact with the surface of the game board. This provides the illusion that the mouth of the shark is opening as the forward end 48 rises upwardly and that the mouth is closing when the forward end moves back downwardly. It will also be noted that there is an undercut portion 52 at the forward end of the shark body which is made to represent the upper teeth of the shark's mouth This further contributes to the aforesaid mouth-opening illusion. Having the entire body raise upwardly in this manner is preferred to having a pivoted mouth or jaw that opens relative to the rest of the structure. The construction is simpler and less costly to manufacture, assemble and maintain, and there is no need for structure of the mouth to have to move underneath the objects (in this case, the fish) to eat them.

The representation of only the front portion of the shark combines with the upward and forward motion of the front end to give an overall illusion of the shark rising out of the water while opening its large jaws—very impressive for young ones.

FIG. 2 also illustrates a skirt or catcher 54 which is movably mounted on the shark body 46 and operates in a way to be described in detail below to maintain the eaten fish captured beneath the advancing shark unit.

Figure 3:
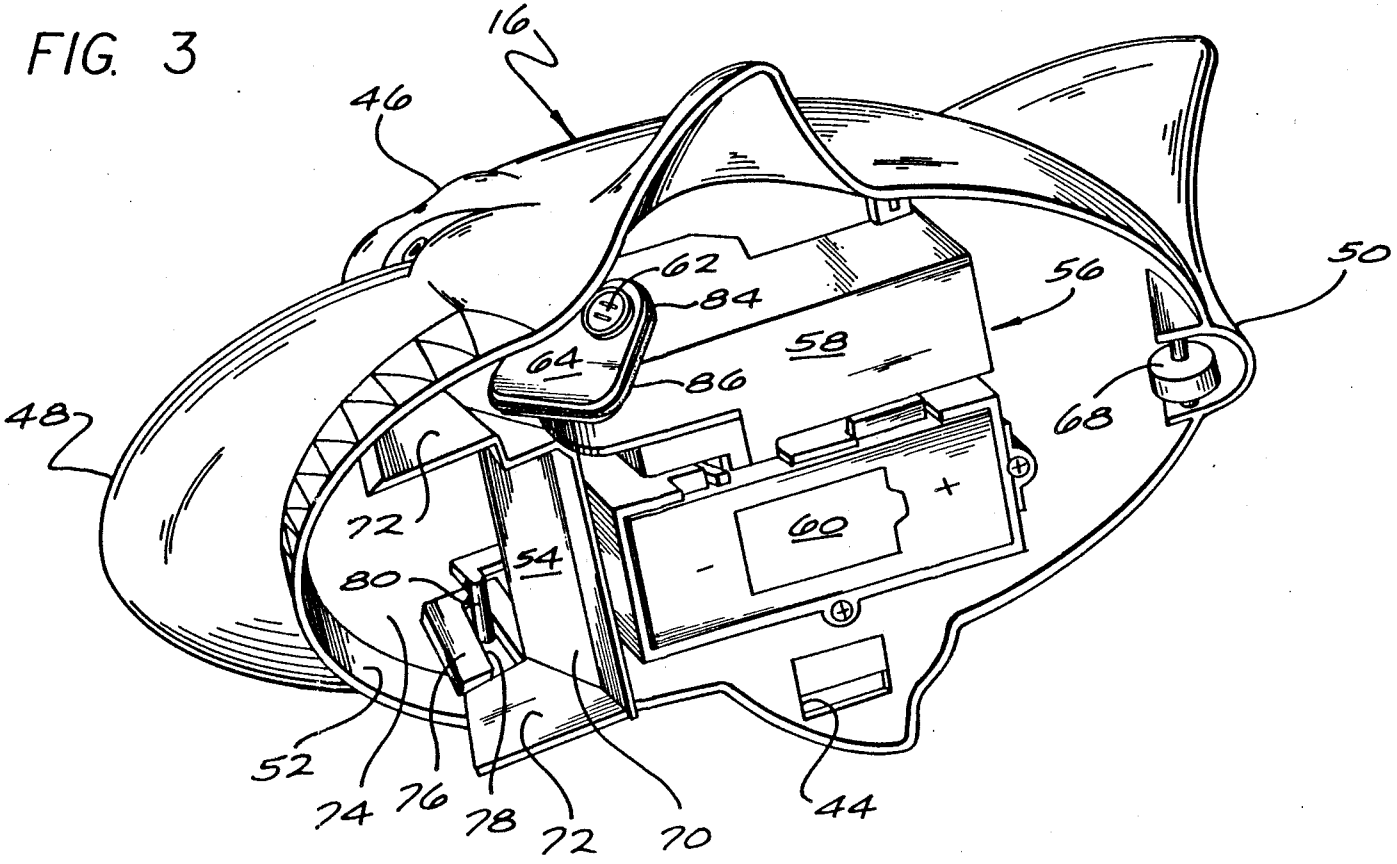
FIG. 3 is an enlarged perspective view from the underside of the shark unit of FIGS. 1 and 2.

FIG. 3 illustrates the shark unit 16 in further detail. The outer body 46 representing the front portion of the shark is hollow and contains a frame or inner housing 56. The inner housing 56 includes a housing portion or unit 58 on one side that contains an electric motor and a reduction gear train. The housing 56 includes a housing portion or unit 60 on the other side that contains batteries. The batteries power the motor to drive the gear train to rotate an output shaft 62 that extends outwardly from the side of the motor housing portion 58 away from the board center. The shaft 62 rotates at a predetermined speed, and a suitable cam 64 is fixedly mounted on the shaft as shown in FIGS. 3 and 4. Rotation of the cam 64 causes the incremental forward as well as the up and down movements of the shark body. In a standard and well-known manner, the batteries are connected to the motor which is turned on and off by a control switch 66 located at the top of the shark body (FIGS. 1 and 2). In the play of the game, the motor is turned on by the switch 66, and the motor continues to rotate the cam 64 and thus cause the intermittent continuous advancing and raising and lowering of the shark unit 16 along the pathway 14 until the game is completed, at which time the child can shut off the motor.

As also seen in FIG. 3, a small wheel 68 is rotatably provided at the rear end 50 of the shark body for rolling movement along the game board. This wheel also serves as the pivot about which the forward end of the shark unit raises and lowers.

FIG. 3 also illustrates the mounting of the catcher member 54. In general, catcher member 54 includes a rear transverse wall 70 and a pair of generally forwardly extending sidewalls 72. All of these walls 70 and 72 are generally upright. These walls combine with the generally upright wall of the arcuate-shaped depending undercut teeth portion 52 of the shark body to define a compartment 74 (FIG. 3) where the eaten fish 18 are retained as the shark unit moves forwardly. The catcher 54 is mounted on the shark's body so that it remains generally in contact with or at least in close proximity to the supporting surface when the forward end 48 of the shark body raises upwardly. This is facilitated by the way the catcher 54 is mounted to the shark body. In this connection, the sidewalls 72 of the catcher 54 have upwardly standing extensions 76 which each define a vertically extending slot 78. The shark body has an inwardly extending pin 80 at either side which passes through one of these vertical slots 78. When the shark body raises up, the pins 80 move to the upper ends of the slots 78 and thus allow the catcher 54 to maintain its lowered position relative to the supporting surface. When the shark body lowers, the pins 80 move downwardly through the slots 78 so that this downward movement of the shark body is not restricted.

The cam 64 has a generally triangular, teardrop or pear shape. The cam 64 is mounted to the motor-driven shaft 62 at the apex 84 of the cam, from where the cam extends outwardly along a forward edge 86 and a rear edge 88. At their outer ends, the forward and rear edges 86 and 88 merge through curves or radii into an outer edge 90.

The sequential movement of the shark unit 16 is illustrated by a series of schematic views, FIGS. **4*a* through 4*e***.

In FIG. **4*a*, the shark unit is in its closed-mouth position with the forward end 48 of the shark body in its lowered position. The forward edge 86 of the cam 64 is just coming into contact with the supporting surface. As indicated by the arrow, the cam 64 rotates in a clockwise direction as shown in these Figures. One of the small fish play pieces 18 is shown on the surface in the area 20 immediately forward of the area 20** on which the shark unit is positioned.

FIG. **4*b* shows further rotation of the cam 64, which both moves the shark unit 16 forwardly and begins to elevate the front end 48**.

FIG. **4*c* shows further rotation of the cam 64, which produces further forward movement of the shark unit and further elevation of the front end 48. The outer edge 90 of the cam 64** now engages the surface.

Further rotation of the cam 64 through the connecting area between the outer edge 90 and the rearward edge 88 is shown in FIG. **4*d*. This produces further forward movement while also lowering the forward end 48 of the shark body so as to enclose or cover over the fish 18 within the forward compartment 74 of the shark. In other words, the forward end 48 of the shark body comes down upon the fish 18 with the undercut tooth portion 52 of the shark body around the front of the fish and the catcher 54 at the rear of the fish to confine the fish within that compartment 74**.

Figure 4A:
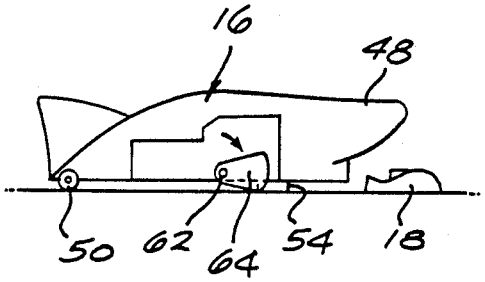
FIG. 4 is a schematic illustration of the shark unit in a sequential series of positions as it advances and raises upwardly and then falls back downwardly onto the supporting surface.
Figure 4B:
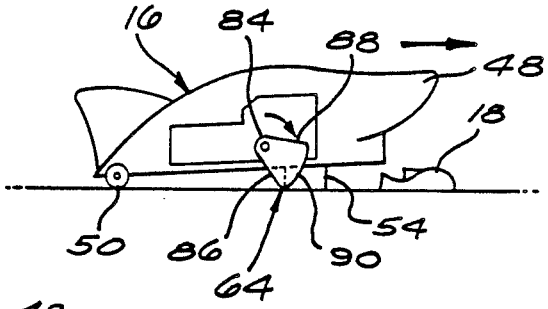
Figure 4C:
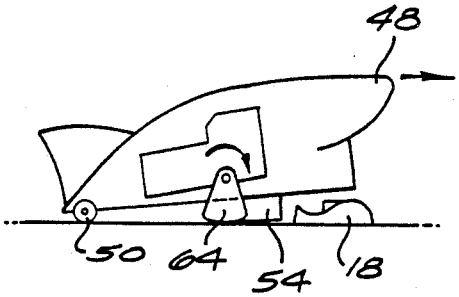
Figure 4D:
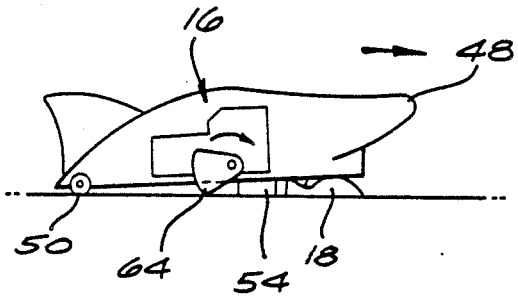
Figure 4E:
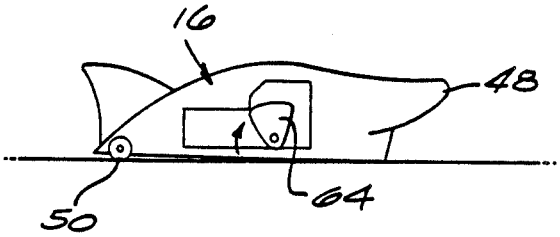

Further rotation of the illustrated cam 64 as shown in FIG. 4*e* allows the shark unit 16 to wait or pause at that area 20 as the cam continues to rotate back toward the position of FIG. 4*a*. The cam 64 will then again engage the support surface and begin a new incremental cycle of forward upward and then downward movement to the next area 20.

The pause between cycles sets a tempo and provides a respite between forward movements to accommodate players' movement of their fish. It also emphasizes each gulp of the shark.

For some applications it might be desired to provide a cam that will not pause but that will go from one successive movement cycle into the next movement cycle. Further, a non-rotary cam or cams might be used. It would also be possible to utilize a varied or multiple cam arrangement where the increments of movement were not equal but varied in some repeating pattern. This would require that the spacing of the areas along the pathway also be varied. This would add variety but also cost and complexity. The apparatus might be provided with multispeeds as by providing multiple batteries and allowing the user to selectively connect the motor to different numbers of the batteries to cause the unit to operate at different speeds. Similarly, the unit might be powered by a wind-up motor, although the time of operation would be drastically reduced; also, as the spring of the wind-up motor wound down, the speed of the movement would greatly diminish. Still further, the unit might be operated on a linear track. However, this would limit the play value of the toy since it would have to be frequently repositioned by the user, and the length and duration of each run down the track would be short compared to the continuous movement around the circular track.

As used in this application, the designation "animated character" refers to and includes not only representations of humans or various animals but also the personification of inanimate objects such as vehicles, plants, machines or mechanical devices, building structures, or the like. It also may include objects which are animated in the sense that they are capable of movement such as toy vehicles, tanks, cars, or buses.

The shark provides the illusion of gulping up little fish. Other forms of the apparatus may provide other illusions. For example, a giant boot or foot could squash or "stomp" objects, or a net could catch animal figures.

The illustrated apparatus may be constructed of any suitable material such as molded plastic, wood, metal or the like. It may include unitary pieces or multiple pieces secured together as by adhesive or heat fabrication methods. Molded plastic pieces are desirable in that they are relatively inexpensive and simple to produce in quantity.

Various other modifications and changes in the illustrated structure might be made without departing from the spirit and scope of the present invention as set forth in the following claim.

We claim:

1. An action toy apparatus comprising:

(a) means defining a pathway with a series of areas therealong;

(b) a frame;

(c) catching means operatively connected to the frame for movement therewith and representing at least a portion of an animated character;

(d) moving means operatively associated with the catching means and the frame for causing the catching means to repeatedly move through a cycle, each cycle including the catching means both:

(i) advancing along the pathway from area to area, while (ii) alternately rising to an elevated position and then falling to a lowered position relative to the pathway, the catching means advancing to each successive area in its elevated position and then falling to its lowered position at that area before again advancing to the next area.

2. An action toy apparatus as set forth in claim 1, wherein the catching means comprises a single unit which rises and falls by virtue of its forward end tilting and rising upwardly relative to its rearward end.

3. An action toy apparatus as set forth in claim 1, wherein each cycling advance movement of the catching means is a generally equal distance and said pathway areas are of generally equal dimension along the length of the pathway.

4. An action toy apparatus as set forth in claim 2, wherein said moving means comprises motor means, reduction gear means, and rotary cam means operatively connected to the motor means through the reduction gear means, said rotary cam means positioned and arranged to engage the supporting surface to effect the movement of the catching means.

5. An action toy apparatus as set forth in claim 4 wherein said motor means is an electric motor and said apparatus also includes battery-holding means, electrical circuit means and an on-off switch accessible from externally of said catching means for selectively connecting said batteries to said electric motor, so as to turn said motor on and off to operate said cam means.

6. An action toy apparatus as set forth in claim 5 wherein said battery holding means are mounted on one side of said apparatus and said motor and reduction gear train means are mounted on the opposite side of said apparatus for symmetry of weight and balance.

7. An action toy apparatus as set forth in claim 4 wherein said cam means is constructed and arranged to provide a pause between cycles of movement of said catching means.

8. An action toy apparatus as set forth in claim 2 wherein the front end of said catching means represents the mouth of the animated character, the apparatus further including a plurality of play pieces adapted to be disposed upon the pathway in the path of the oncoming catching means to be eaten by said animated character.

9. An action toy apparatus as set forth in claim 8 wherein said animated character represents a large fish and said play pieces represent small fish.

10. An action toy apparatus as set forth in claim 8 wherein said forward end of the catching means defines a hollow receptacle at its underside to receive eaten play pieces, said apparatus further including a movable skirt mounted beneath said frame so as to move downwardly when the forward end of the catching means moves upwardly to maintain the lower portion of the skirt means in sufficient proximity to the supporting surface so as to retain the eaten play pieces in the receptacle.

11. An incrementally-advancing toy apparatus comprising:

(a) a frame;

(b) means on the frame defining a movable object with a receptacle at its forward end;

(c) a self-powered motor means mounted on the frame for repeated cycling action that comprises both:

(i) advancing the object forwardly along a supporting surface, and (ii) raising and lowering the forward end of the object relative to the surface in synchronization with the advancing, at each such action said forward end of the object first moving forward and upwardly and then moving downwardly so as to generally contain an object in its path in said receptacle.

12. An action toy apparatus as set forth in claim 11, wherein the object comprises a single unit which rises and falls by virtue of its forward end tilting and rising upwardly relative to its rearward end.

13. An action toy apparatus as set forth in claim 11, wherein said motor means comprises an electrical motor, a reduction gear train, and a movable cam operatively connected to the motor through the reduction gear train, said cam positioned and arranged to repeatedly engage the supporting surface to effect at least the rising and falling movement of the object.

14. An action toy apparatus as set forth in claim 13, wherein said cam is rotary and is proportioned and arranged to effect both the rising and the falling movement of the forward end of the object and also to advance the object forwardly.

15. An action toy apparatus as set forth in claim 14 wherein said cam is constructed and arranged to provide a pause between cycles of movement of said object.

16. An action toy apparatus as set forth in claim 12 wherein the front end of said character represents the mouth of an animated character, the apparatus further including a plurality of play pieces adapted to be disposed in the path of the oncoming character to be eaten by said animated character.

17. An action toy apparatus as set forth in claim 16 wherein said receptacle at the forward end of the character receives eaten play pieces, said apparatus further including a movable skirt mounted beneath said frame so as to move downwardly when the forward end of the character moves upwardly to maintain the lower portion of the skirt means in sufficient proximity to the supporting surface so as to retain the eaten play pieces in the receptacle.

18. An action toy apparatus as set forth in claim 17 wherein said skirt has connection means and said adjacent front end has connection means, one of said connection means being a pair of opposed generally vertical slots and the other of said connection means being a pair of opposed transversely extending pins each received in one of said slots for generally vertical movement relative to the slot.

19. An action toy apparatus as set forth in claim 12 wherein said unitary catching means includes a rotary wheel means at its rearward end.

20. Action game apparatus comprising:

(a) a flat board defining an upper support surface with a circular pathway and a connector at the center of the pathway, said pathway being divided into a plurality of sequentially aligned areas;

(b) an elongated element connected at one end to the connector;

(c) an animated character connected to other end of connector and disposed on the circular pathway;

(d) a plurality of play pieces disposed on areas of the pathway; and (e) cycling means operatively associated with the character to sequentially cause the character to advance from a current area to the next area on the pathway while rising upwardly and then moving downwardly at said next area so as to cover over any of said pieces on such next area.

21. An action game apparatus as set forth in claim 20, wherein the character comprises a single unit which rises and falls by virtue of its forward end tilting and rising upwardly relative to its rearward end.

22. An action game apparatus as set forth in claim 21, wherein said cycling means comprises motor means, reduction gear means, and cam operatively connected to the motor means through the reduction gear means, said cam positioned and arranged to engage the supporting surface to effect the cycling movement of the character.

23. An action game apparatus as set forth in claim 22, wherein said cam is rotary and is located on the side of the character outwardly from the center of the pathway.

24. An action game apparatus as set forth in claim 21 wherein said character and said elongated element are releasably detachable from one another and from the connector for packaging, shipment and storage.

25. An action game apparatus as set forth in claim 20 wherein said elongated element is a rigid member.

26. An action game apparatus as set forth in claim 20 wherein said elongated element is a cord.

27. An action game apparatus as set forth in claim 20 wherein each advance of the character is a generally equal distance and said pathway areas are of generally equal dimension along the length of the pathway.

* * * * *